US007672631B2

(12) United States Patent
Lucas et al.

(10) Patent No.: US 7,672,631 B2
(45) Date of Patent: Mar. 2, 2010

(54) FUSER ASSEMBLY HAVING HEATER ELEMENT WITH SPACED-APART FEATURES

(75) Inventors: Russell Edward Lucas, Lexington, KY (US); Katherine Mary Mulloy, Lexington, KY (US); Jerry Wayne Smith, Irvine, KY (US); Fangsheng Wu, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 486 days.

(21) Appl. No.: 11/609,035

(22) Filed: Dec. 11, 2006

(65) Prior Publication Data

US 2008/0138129 A1 Jun. 12, 2008

(51) Int. Cl.
*G03G 15/20* (2006.01)

(52) U.S. Cl. ..... 399/329; 399/122; 399/328

(58) Field of Classification Search ..... 399/122, 399/320, 328, 329, 335, 338
See application file for complete search history.

(56) References Cited

U.S. PATENT DOCUMENTS 5,306,898 A * 4/1994 Yukawa et al. ..... 219/543
5,732,318 A * 3/1998 Natsuhara et al. ..... 399/329
6,090,305 A 7/2000 Balch et al.
6,689,528 B2 2/2004 Ream et al.
6,818,290 B1 11/2004 Chopra et al.
6,879,803 B2 4/2005 Gogate et al.
7,005,611 B2 2/2006 Hamilton et al.
2004/0035843 A1 2/2004 Hamilton et al.
2006/0067751 A1 3/2006 Gilmore
2006/0067754 A1 3/2006 Gilmore et al.
2006/0133867 A1 6/2006 Coleman et al.

OTHER PUBLICATIONS

U.S. Appl. No. 11/468,516, filed Aug. 30, 2006, Lucas et al.

* cited by examiner

*Primary Examiner*—David M Gray
*Assistant Examiner*—Benjamin Schmitt

(57) ABSTRACT

A heater element is provided adapted to heat a belt in a fuser assembly. The heater element comprises laterally spaced-apart first and second features. The first feature may have a first inner surface and the second feature may have a second inner surface facing the first inner surface. Preferably, at least a majority portion of at least one of the first and second inner surfaces is positioned at an oblique angle relative to a reference line extending substantially perpendicular to a path a substrate moves along as it passes through the fuser assembly.

22 Claims, 11 Drawing Sheets

FUSER ASSEMBLY HAVING HEATER ELEMENT WITH SPACED-APART FEATURES

TECHNICAL FIELD AND INDUSTRIAL APPLICABILITY OF THE INVENTION

The present invention relates to a fuser assembly including structure to reduce wrinkling in substrates passing through the fuser assembly.

BACKGROUND OF THE INVENTION

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to media, such as a paper substrate, intended to receive the final permanent image. The toner image is fixed to the media by the application of heat and pressure in a fuser assembly. A fuser assembly may include a heated roller and a backup roller forming a fusing trip through which the media passes. A fuser assembly may also include a fuser belt and an opposing backup member, such as a backup roller. Processing of substrates such as sheets of paper through the fusing trip compresses and flattens the sheet just before or as the image is being fixed onto the surface of the sheet.

Paper substrates are usually packaged in reams of 500 sheets enclosed in a protective, often waterproof wrapper. Since paper is somewhat hygroscopic, paper substrates may absorb moisture when exposed to ambient air. Depending on storage conditions for the paper substrates, once the protective packaging has been opened, the paper may absorb moisture from the surrounding air causing the fibers of the paper to swell and lengthen. This may result in a change in the dimensions of the paper substrates depending on whether the moisture is absorbed uniformly or non-uniformly across the length and width of each substrate. Such moisture absorption may lead to wavy edges being formed.

FIG. 1 illustrates a paper substrate 1 which has been exposed to a high level of ambient humidity on one end or edge 2, such as where a protective packaging for a ream from which the substrate 1 was taken has been opened only at one end. Thus, moisture was absorbed at the one exposed edge 2 creating a moisture gradient from the exposed edge 2 to a drier protected opposite edge 5 which was covered by the packaging. The moisture gradient caused the exposed edge 2 to lengthen in the width-wise direction, due to the swelling of the paper fibers. However, the substrate edge 2 is constrained by the dimensions of a dry portion 3 of the substrate 1 such that a boundary condition is essentially set up that will not allow the lengthened or widened edge 2 of the sheet to be substantially wider than the dry portion 3. Hence, the edge 2 becomes wavy or buckles due to this constraint and remains essentially the same effective horizontal width as the remainder of the substrate 1. In other words, for an 8.5"×11" size substrate of paper, the distance between corners 4 and 4' remains about 8.5".

If the substrate 1 is fed with the wavy edge 2 first through a conventional fusing nip 6, which may be defined by a pair of fusing rollers, the edge 2 may be pressed out by the compressive forces applied by the nip 6, making the edge 2 flat, see FIG. 2. The edge 2 is now wider than the width of the dry portion 3, resulting in non-parallel outer edges 2A and 3A on each side of the substrate 1. Due to stress reactions in the non-parallel outer edges 2A and 3A of the substrate 1, corrugations 8 are formed in the substrate 1, see FIG. 3. The corrugations 8 are formed into wrinkles 8A as the substrate 1 passes through the nip 6. The wrinkles 8A cause defective copies and customer complaints.

U.S. Patent Application Publication No. US 2006/0133867 A1, the entire disclosure of which is incorporated herein by reference, provides one solution to this problem. U.S. patent application Ser. No. 11/468,516, entitled "Fuser Assembly Having Heater Element With Spaced-Apart Features", filed on Aug. 30, 2006, the entire disclosure of which is incorporated herein by reference, provides another solution to this problem. Other solutions for reducing wrinkling in paper substrates having one or more wavy edges are desirable.

SUMMARY OF THE INVENTION

In accordance with a first aspect of the present invention, a heater element is provided adapted to heat a belt in a fuser assembly. The heater element comprises laterally spaced-apart first and second features. The first feature may have a first inner surface and the second feature may have a second inner surface facing the first inner surface. Preferably, at least a majority portion of at least one of the first and second inner surfaces is positioned at an oblique angle relative to a reference line extending substantially perpendicular to a path a substrate moves along as it passes through the fuser assembly.

The features are preferably positioned near an input edge of the heater element.

The majority portion of the first inner surface may face an input edge of the heater element or may face away from an input edge of the heater element.

The majority portion of the first inner surface may be linear, curvilinear or have another shape.

The heater element may further comprise a substrate having first and second outer surfaces; material provided on the substrate first outer surface; and one or more glass layers provided over the material. At least one section of the substrate first outer surface may not include the material. A first portion of the material provided on the substrate first outer surface may define elements capable of generating heat.

A portion of each of the one or more glass layers may define a portion of one of the first and second features.

The material may further comprise second portions provided on the substrate first outer surface for defining portions of the first and second features.

One or more additional layers of material may be provided only in areas corresponding to the features for defining portions of the features.

In accordance with a second aspect of the present invention, an apparatus is provided for fixing a toner image on a substrate. The apparatus comprises a heater assembly, a flexible belt, and a driven backup member. The heater assembly may comprise a housing and a heater element mounted in the housing. The flexible belt may be positioned about the heater assembly and include an inner surface engageable with the heater element so as to receive energy in the form of heat generated by the heater element. The driven backup member may be positioned in opposition to the heater assembly. The flexible belt preferably extends between the heater assembly and the driven backup member such that a fusing nip for receiving a substrate is defined between the backup member and the flexible belt at a location where the belt passes below a center portion of the heater element. The heater element may comprise laterally spaced-apart first and second features facing the belt inner surface. The backup member causes the belt to engage the first and second features along respective first and second lines of contact. The first line of contact may terminate at a first edge of the first feature and the second line of contact terminate at a second edge of the second feature. The first line of contact and the first edge may define a first oblique angle and the second line of contact and the second edge may define a second oblique angle.

The first feature may comprise a first inner surface having an edge defining the first edge and the second feature may comprise a second inner surface having an edge defining the second edge. The second inner surface may face the first inner surface. Majority portions of the first and second inner surfaces are preferably positioned at oblique angles relative to the first and second lines of contact.

DETAILED DESCRIPTION OF THE INVENTION

In the following detailed description of the preferred embodiments, reference is made to the accompanying drawings that form a part hereof; and in which is shown by way of illustration, and not by way of limitation, specific preferred embodiments in which the invention may be practiced. It is to be understood that other embodiments may be utilized and that changes may be made without departing from the spirit and scope of the present invention.

Figure 4:
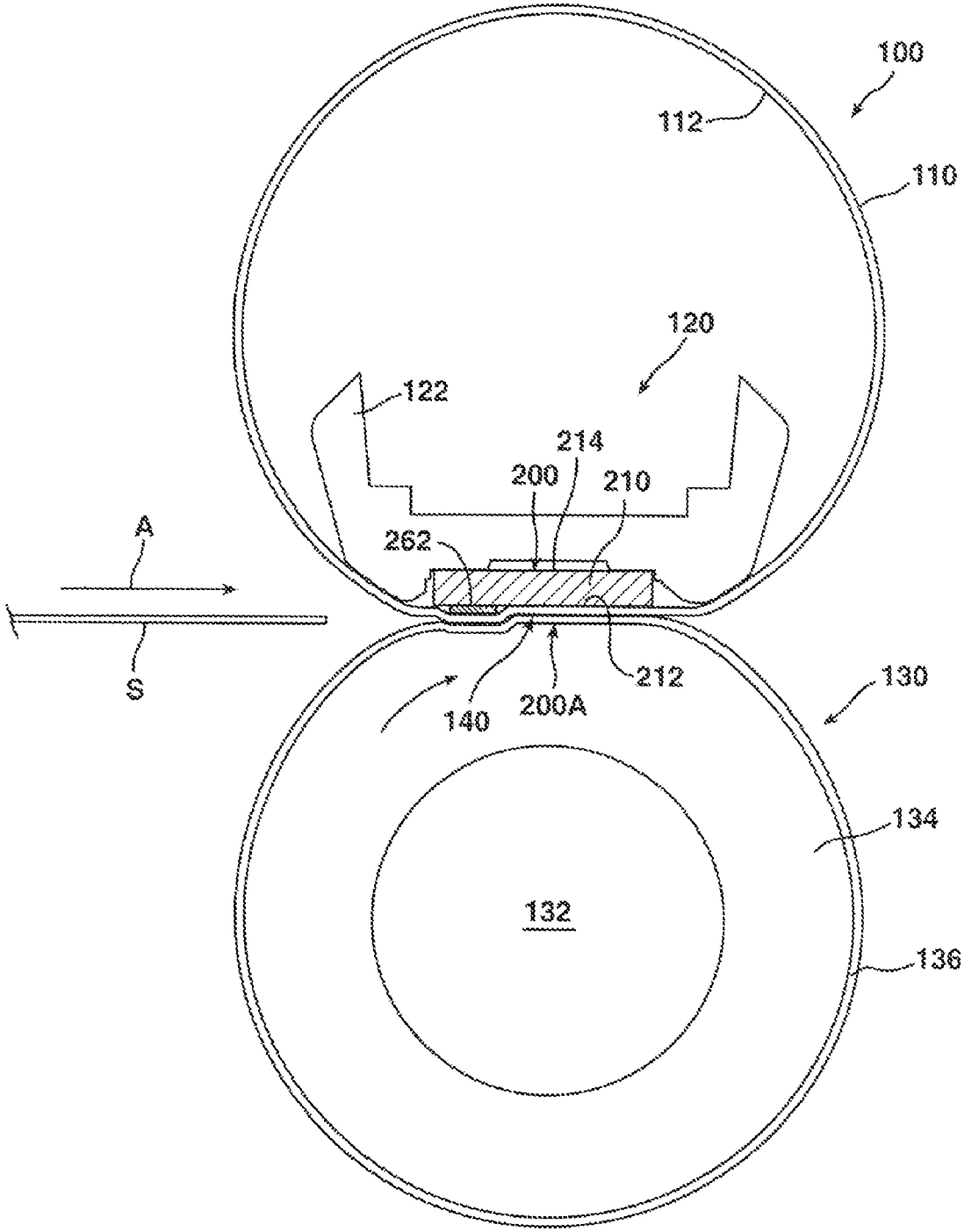
FIG. 4 is a side view, partially in cross section, of a fuser assembly constructed in accordance with the present invention.

A fuser assembly 100 formed in accordance with the present invention is illustrated in FIG. 4. The fuser assembly 100 comprises a flexible endless belt 110, a heater assembly 120 and a backup member in the form of a roller 130. In the illustrated embodiment, the backup roller 130 is driven and the fuser belt 110 is an idler belt. However, the drive scheme may be reversed. The fuser belt 110 and the backup roller 140 define a fusing trip 140 therebetween for receiving a substrate S with toner thereon.

The endless belt 110 may comprise an inner base layer comprising polyimide with a thermally conductive filler, a first primer layer adjacent the polyimide layer with an electrically conductive filler, and an outer release layer having an electrically semiconductive filler. An example belt 110 is disclosed in U.S. Pat. No. 6,689,528, the disclosure of which is incorporated herein by reference.

The heater assembly 120 may comprise a high temperature housing 122 formed from a polymeric material such as a liquid crystal polymer. A heater element 200 is fixed to the housing 122 such as by a thermally cured silicone adhesive. The flexible belt 110 may be positioned about the heater assembly 120. The belt 110 includes an inner surface 112 engageable with the heater element 200 so as to receive energy in the form of heat generated by the heater element 200. The heater element 200 will be discussed in detail below.

The backup roller 130 may comprise an inner core 132, an inner polymeric layer 134 and an outer toner release layer or sleeve 136. The inner core 132 may be formed form a polymeric material, steel, aluminum or a like material. The inner polymeric layer 134 may be formed from a silicone foam or rubber material. The outer release layer 136 may comprise a sleeve formed form PFA (polyperfluoroalkoxy-tetrafluoroethylene) or other fluororesin material. The outer release layer 136 may also be formed via a latex and/or PFA spray coating. A conventional drive mechanism (not shown) is provided for effecting rotation of the backup roller 130.

Figure 7A:
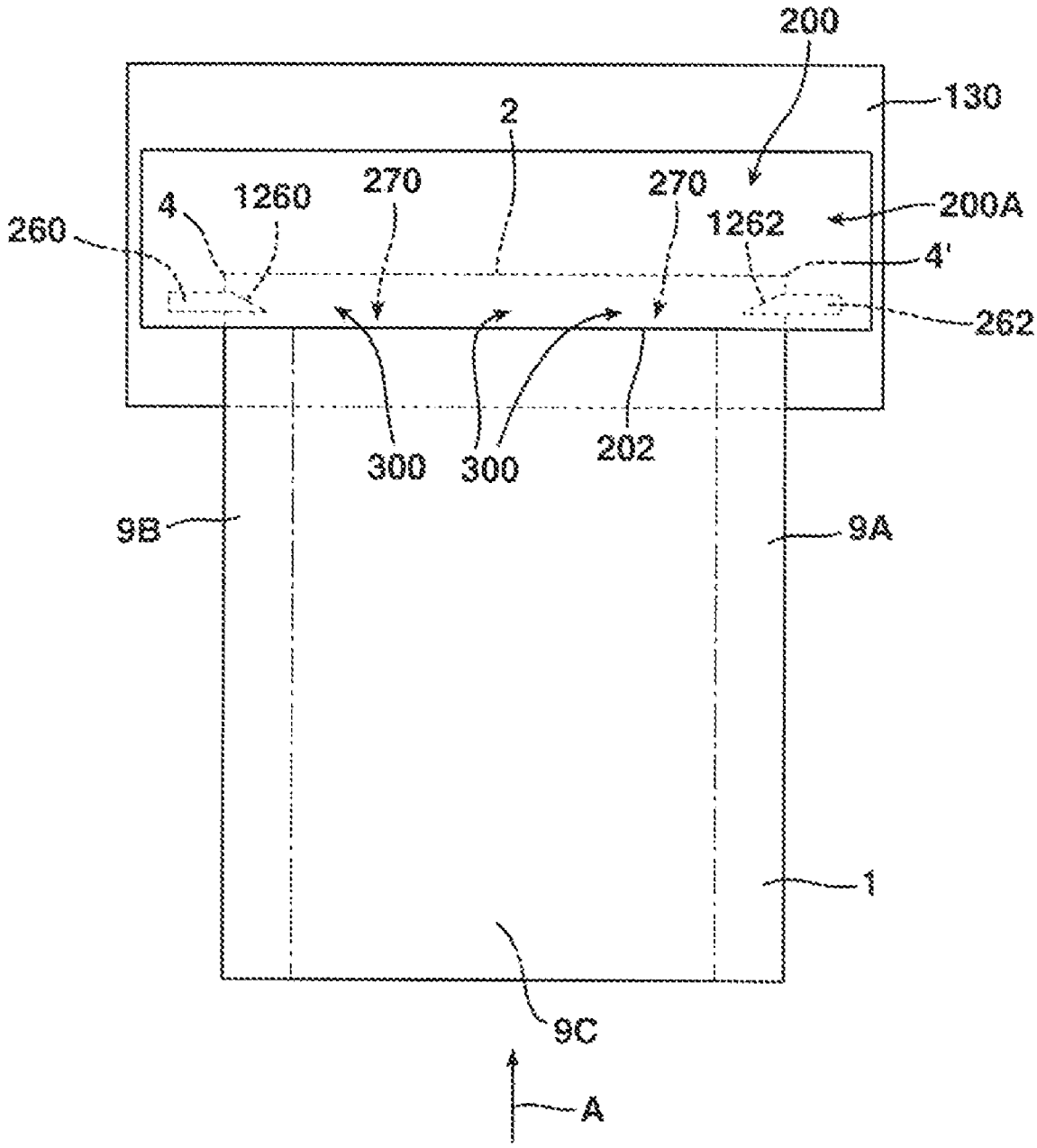
FIGS. 7A and 7B illustrate a substrate, such as the one shown in FIG. 1, passing between the heater element and backup roller illustrated in FIG. 4 and wherein the belt has been removed.
Figure 7B:
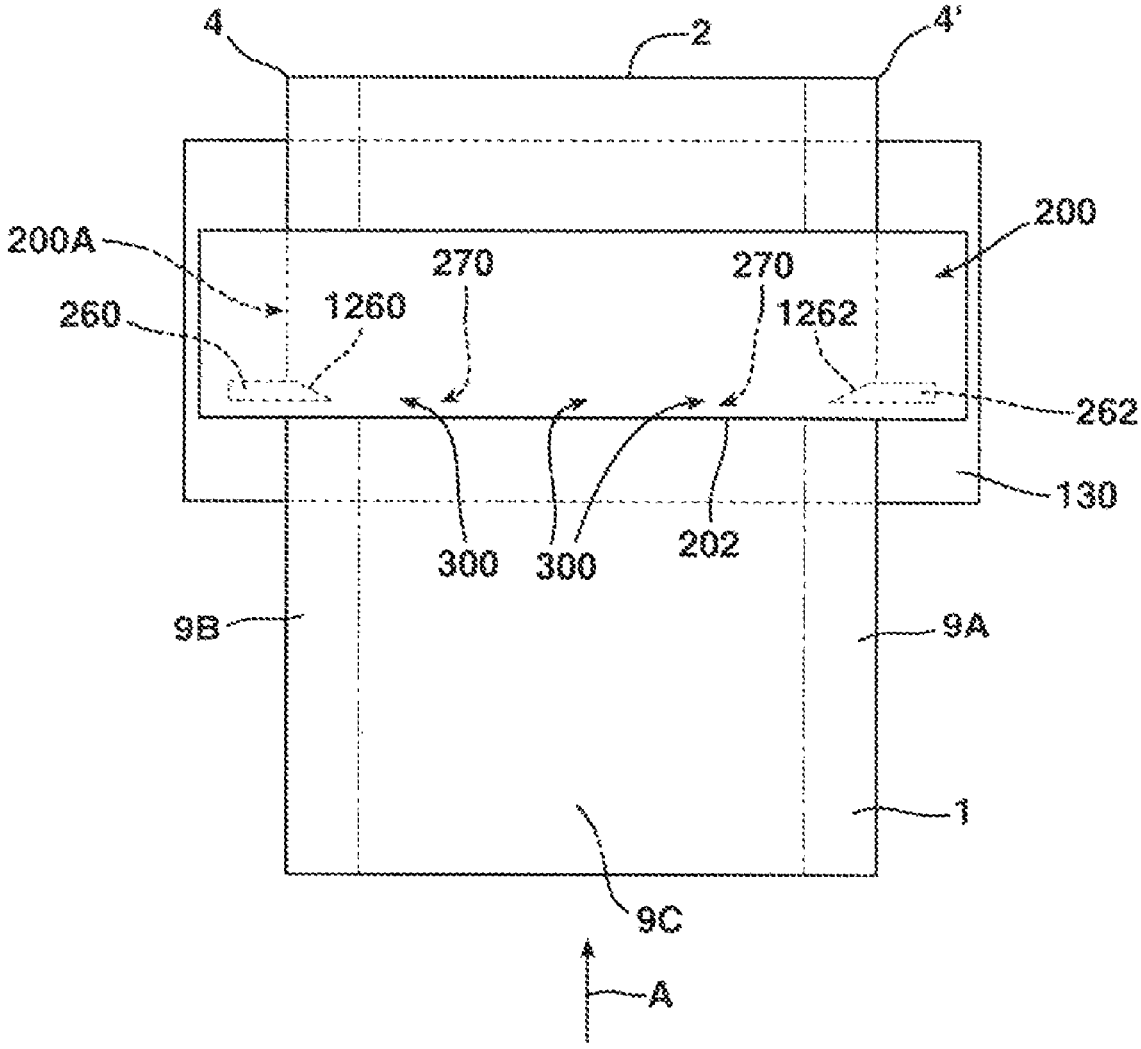

A substrate transport device (not shown) such as a belt, may be provided to feed substrates S along a substrate path A such that the substrate S enter one at a time into the fusing nip 140, see FIGS. 4, 7A, 7B. A toner image is provided on each substrate S via one or more imaging stations, such as disclosed in U.S. Patent Application Publication 2006/0067754 A1, the disclosure of which is incorporated herein by reference. The toner image is fused to the substrate S by the belt 110, the heater element 200 and the backup roller 130 applying heat and pressure to the substrate/toner image. In the illustrated embodiment, rotation of the backup roller 130 effects movement of a substrate S through the fusing nip 140. Movement of the backup roller 130 and substrate S causes the fuser belt 110 to move relative to the heater element 200.

Figure 5A:
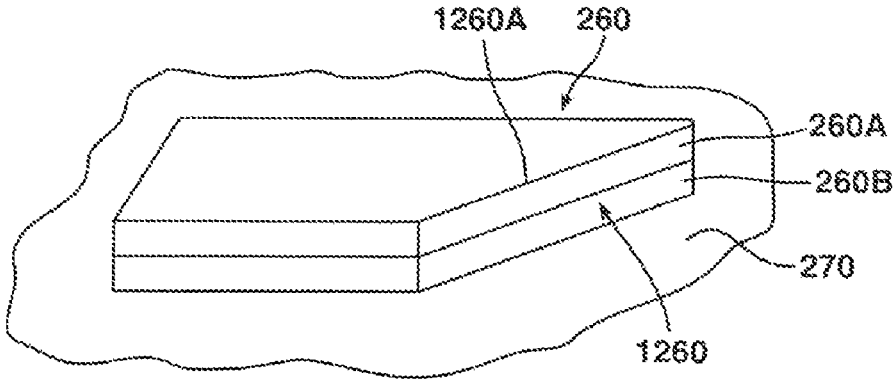
FIG. 5A is a perspective view of the first feature illustrated in FIG. 5.
Figure 5:
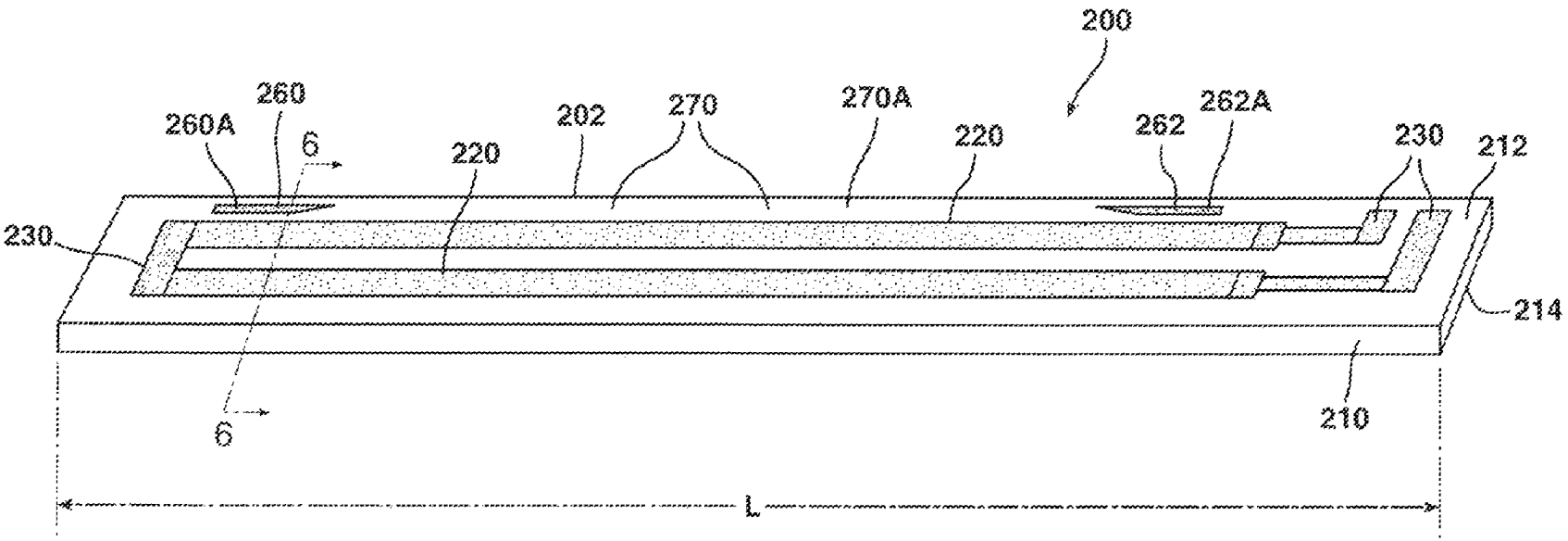
FIG. 5 is a perspective view of a heater element constructed in accordance with a first embodiment of the present invention.
Figure 6:
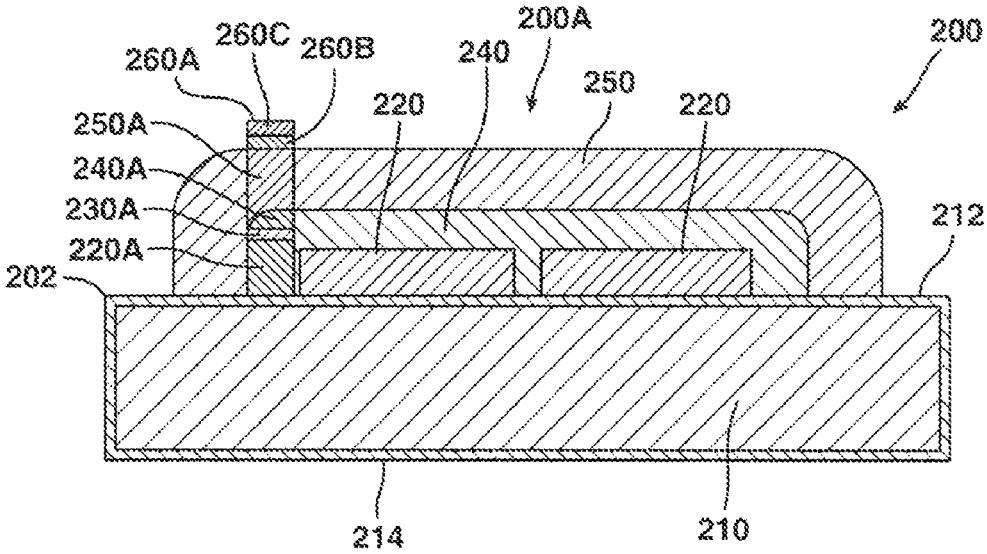
FIG. 6 is a view taken along section line 6-6 in FIG. 5.

In the illustrated embodiment, the heater element 200 comprises a ceramic substrate 210 having first and second outer surfaces 212 and 214, see FIGS. 4-6. The substrate 210 has a length 1, see FIG. 5, that extends substantially perpendicular to a belt moving direction and the substrate path A. The ceramic substrate 210 may be formed form 96% alumina, such as disclosed in U.S. Pat. No. 7,005,611, the entire disclosure of which is incorporated herein by reference, aluminum nitride or the like.

Figure 8:
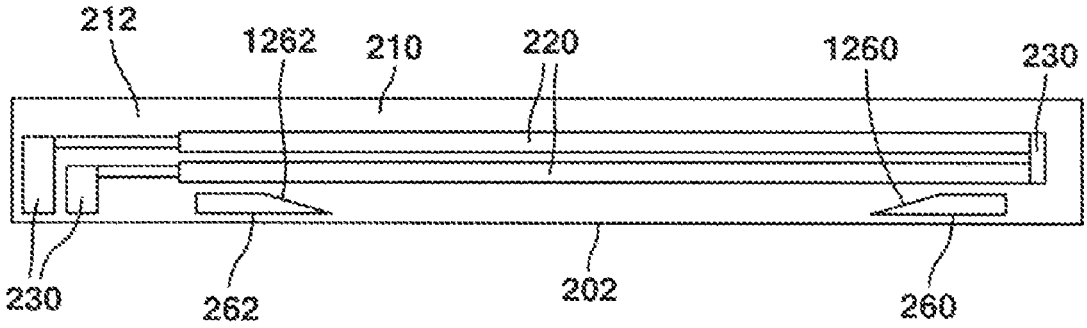
FIG. 8 is a top view of the heater element constructed in accordance with the first embodiment of the present invention.

Formed on the first outer surface 212 of the substrate 210 are a plurality of resistors 220 capable of generating heat when provided with electrical power, see FIGS. 5, 6 and 8. The resistors 220 may extend along substantially the entire length L of the substrate 210, see FIG. 5. The resistors 220 may be formed on the substrate first outer surface 212 via a conventional thick film printing process using a material such as a silver palladium paste.

Also formed on the ceramic substrate first outer surface 212 are a plurality of conductors 230, see FIGS. 5 and 8. The conductors 230 overlap or engage the resistors 220 and provide paths for electrical energy to travel to the resistors 220 from a power supply (not shown). The conductors 230 may be formed via a conventional thick film printing process using a material such as a silver palladium paste or a silver platinum paste.

The heater element 200 in the illustrated embodiment further comprises a glass dielectric layer 240, which functions to electrically insulate the heater element outer surface, see FIG. 6. The dielectric layer 240 is formed over the resistors 220 and conductors 230. Further, the dielectric layer 240 is formed via a conventional thick film printing process using an insulation glass material such as one commercially available from Asahi Glass Company under the product designation AP5707. While only a single dielectric layer 240 is shown in the illustrated embodiment, a plurality of such layers may be provided on the heater element 200.

A glass overglaze layer 250 is formed over the dielectric layer 240, see FIG. 6. The glass overglaze layer 250 may be formed via a conventional thick film printing process using a cover glass material such as one commercially available from Asahi Glass Company under the product designation AP5349. While only a single overglaze layer 250 is shown in the illustrated embodiment, a plurality of such layers may be provided on the heater element 200.

It is contemplated that the dielectric layer 240 may be replaced by another glass overglaze layer 250.

It is also contemplated that other conductors (not shown) may be formed on the ceramic substrate second outer surface 214. A thermistor chip (not shown) may be attached to the substrate second outer surface 214.

Figure 6A:
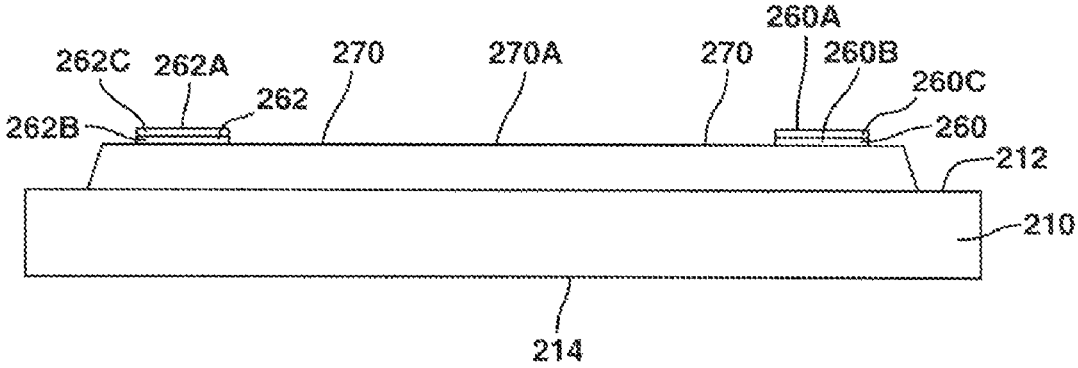
FIGS. 6A and 6B are side views of the heater element illustrated in FIG. 5.

In the illustrated embodiment, a pair of laterally spaced-apart first and second features 260 and 262 are provided on the heater element 200, see FIGS. 5 and 8. The features 260 and 262 are formed over the substrate first outer surface 212 and extend out beyond, i.e., above, a center section 270 of the heater element 200 located between the features 260 and 262, see FIGS. 6A and 6B. Hence, the outermost surface 260A, 262A of each feature 260, 262 is spaced a further distance away from the substrate first outer surface 212 than an outer surface 270A of the center section 270, see FIGS. 6A and 6B. In this embodiment, the outer surface 270A of the center section 270 is defined by a portion of the outer surface of the overglaze layer 250.

Figure 6B:
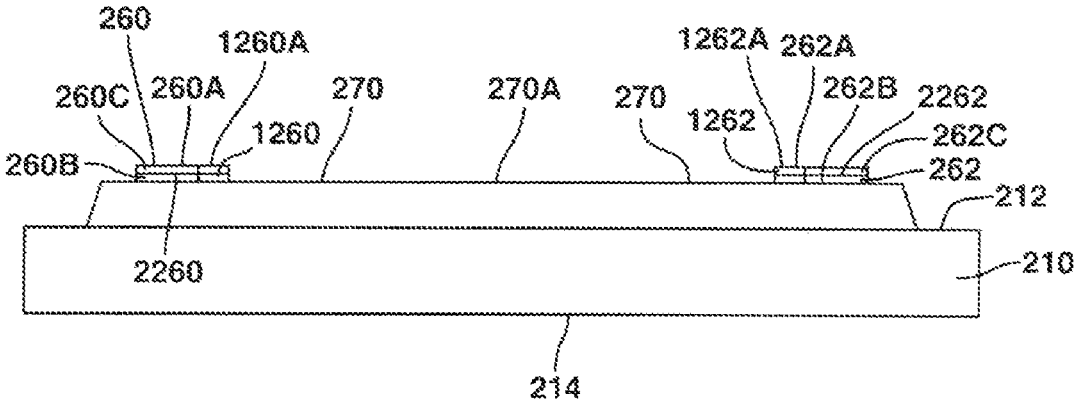
Figure 8A:
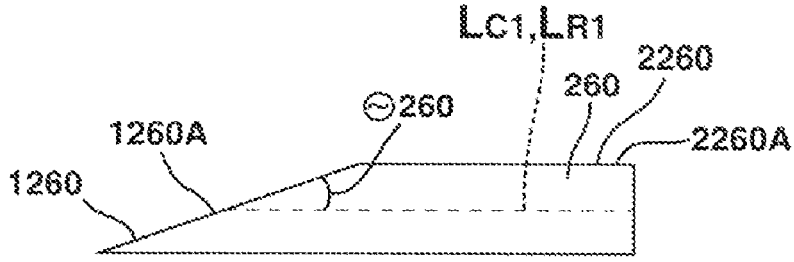
FIGS. 8A and 8B are top views of the first and second features illustrated in FIG. 8.

In the embodiment in FIGS. 5, 5A, 6, 6A, 6B, 7A, 7B, 8, 8A and 8B, the first feature 260 comprises a first inner surface 1260 having a first upper edge 1260A, see FIGS. 5A, 6B and 8A. The second feature 262 comprises a second inner surface 1262 having a second upper edge 1262A, see FIGS. 6B and 8B. As is apparent from FIGS. 7A, 7B, and 8, the first inner surface 1260 faces the second inner surface 1262. As is also apparent from FIG. 8, the first and second inner surfaces 1260 and 1262 face away from a substrate input edge 202 of the heater element 200.

Figure 8B:
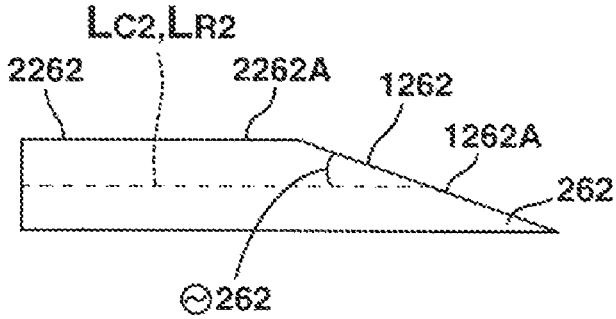

During operation of the fuser assembly 100, the backup roller 130 causes the belt 110 to engage the first feature 260 between a first line of contact $L_{C1}$ and an upper edge 2260A of a first rear surface 2260 and the second feature 262 between a second line of contact $L_{C2}$ and an upper edge 2262A of a second rear surface 2262, see FIGS. 8A and 8B. The first line of contact $L_{C1}$ and the first upper edge 1260A of the first inner surface 1260 define a first oblique angle $\theta_{260}$ having a value of between about 5 degrees and 65 degrees and preferably about 15 degrees, see FIG. 8A. The second line of contact $L_{C2}$ and the second upper edge 1262A of the second inner surface 1262 define a second oblique angle $\theta_{262}$ having a value of between about 5 degrees and 65 degrees and preferably about 15 degrees, see FIG. 8B. Since the first inner surface 1260 is parallel to the first upper edge 1260A, the first line of contact $L_{C1}$ and the first inner surface 1260 also define the first oblique angle $\theta_{260}$. Similarly, since the second inner surface 1262 is parallel to the second upper edge 1262A, the second line of contact $L_{C2}$ and the second inner surface 1262 also define the second oblique angle $\theta_{262}$. In the illustrated embodiment, the first and second lines of contact $L_{C1}$ and $L_{C2}$ are substantially perpendicular to the substrate path A.

First and second reference lines $L_{R1}$ and $L_{R2}$, which also extend substantially perpendicular to the substrate path A, overlap, are coextensive with and are defined by the first and second lines of contact $L_{C1}$ and $L_{C2}$ in this embodiment, see FIGS. 8A and 8B. Hence, the first reference line $L_{R1}$ and the first upper edge 1260A of the first inner surface 1260 also define the first oblique angle $\theta_{260}$ and the second reference line $L_{R2}$ and the second upper edge 1262A of the second inner surface 1262 also define the second oblique angle $\theta_{262}$. In the event the first and second lines of contact $L_{C1}$ and $L_{C2}$ are not substantially perpendicular to the substrate path A, the first and second reference lines $L_{R1}$ and $L_{R2}$ remain defined as being substantially perpendicular to the substrate path A.

Figure 7C:
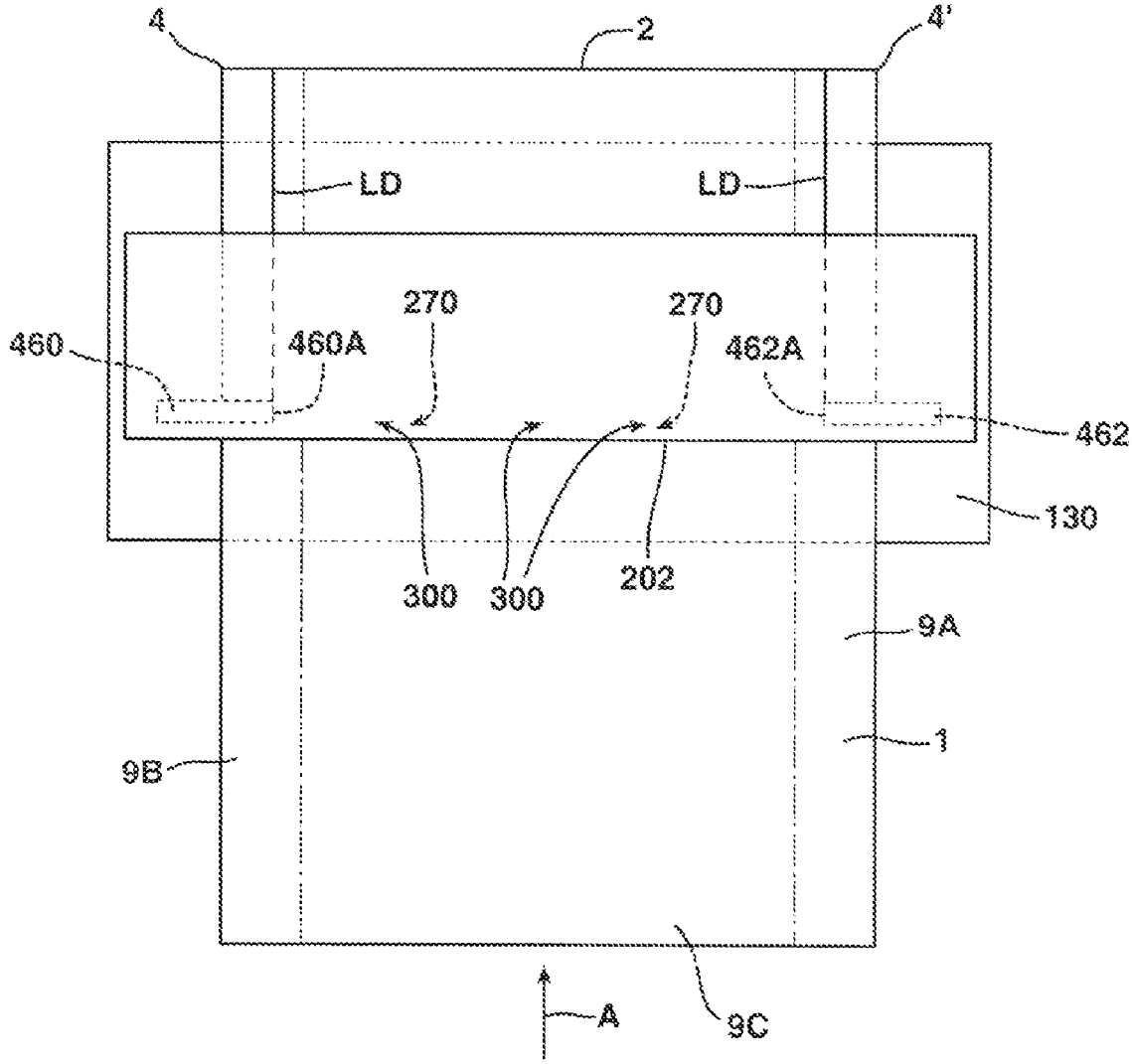
FIG. 7C is a view similar to FIG. 7B with the first and second features having inner surfaces substantially parallel to a path a substrate moves along as it passes through the fuser assembly.

It has been found that when first and second features 460 and 462 have rectangular shapes such that inner surfaces 460A, 462A of the first and second features 460, 462 define planar surfaces parallel to the substrate path A, see FIG. 7C, print defects may occur in the toner image on the substrate. The print defects may take the form of lines of discoloration LD running parallel to the inner surfaces 460A, 462A of the first and second features 460, 462, again see FIG. 7C. It is believed that there is a line extending substantially parallel to and having a length substantially equal to the length of the edge 460A, which line separates a first low-pressure contact area between the belt 110 and the backup roller 130 and an area 300 between the features 460A, 462B, where a substrate is not gripped by the belt 110 and the backup roll 130. It is also believed that there is a line extending substantially parallel to and having a length substantially equal to the length of the edge 462A, which line separates a second low-pressure contact area between the belt 110 and the backup roller 130 and the area 300 between the features 460A, 462A. It is believed that at each line separating a corresponding low-pressure contact area and the area 300, a prolonged concentration of mechanical forces occurs along a linear section of the toner image, which is substantially parallel to the corresponding edge 460A, 462A, resulting in the corresponding line of discoloration LD being formed.

In the present invention, because the first and second inner surfaces 1260, 1262 and, hence, the first and second upper edges 1260A and 1262A extend at angles $\theta_{260}$, $\theta_{262}$ to the first and second lines of contact $L_{C1}$, $L_{C2}$ and the first and second reference lines $L_{R1}$ and $L_{R2}$, no clearly detectable lines of discoloration occur in portions of a toner image passing adjacent the first and second inner surfaces 1260, 1262 of the first and second features 260, 262. It is believed that there is a line extending substantially parallel to and having a length substantially equal to the length of the edge 1260A, which line separates a first low pressure contact area between the belt 110 and the backup roller 130 and an area 300 between the features 260, 262, where a substrate is not gripped by the belt 110 and the backup roll 130. It is also believed that there is a line extending substantially parallel to and having a length substantially equal to the length of the edge 1262A, which line separates a second low-pressure contact area between the belt 110 and the backup roller 130 and the area 300. Due to the locations of the upper edges 1260A, 1262A of the features 260, 262, it is believed that mechanical forces acting on a toner image and extending along the lines separating the low-pressure contact areas and the are 300 between the features 260, 262 are spread out across a portion of the toner image in a direction non-parallel to the direction of the substrate path A so as not to be concentrated along linear sections of the toner image extending substantially parallel to the substrate path A. Hence, a prolonged concentration of mechanical forces along a linear section of the toner image extending substantially parallel to the substrate path A does not occur in this embodiment.

At least a portion of the features 260 and 262 may be formed on the substrate first outer surface 212 during the same process operations and from the same materials used to form the resistors 220, conductors 230, glass dielectric layer 240 and glass overglaze layer 250. For example, when resistor material is applied to the substrate first outer surface 212 to form the resistors 220, additional resistor material 220A may be applied to the substrate first outer surface 212 in areas on the surface 212 where the features 260 and 262 are to be formed, i.e., near the substrate input edge 202 of the heater element, see FIG. 6. When conductor material is applied to the substrate first outer surface 212 to form the conductors 230, additional conductor material 230A may be applied over the resistor material 220A in the areas where the features 260 and 262 are being formed so as to form second layer defining further portions of the features 260, 262. Thereafter, when the glass dielectric layer 240 is formed, additional glass dielectric material 240A used to form the layer 240 may be provided over the conductor material 230A in the areas where the features 260 and 262 are being formed so as to form third layers of the features 260, 262. In a similar manner, when the glass overglaze layer 250 is formed, additional glass overglaze material 250A used to the form the layer 250 may be provided over the glass dielectric material 240A in the areas where the features 260, 262 are being formed so as to form fourth layers of the features 260, 262. Hence, portions of the features 260, 262 may be formed from layers of the same materials used to form the conductors 220, the resistors 230, and the glass layers 240, 250.

It is also contemplated that layers of additional material, such as one or more cover glass layers or printable polyimide layers, may be formed only in the areas where the features 260, 262 are being formed so as to provide additional material layers defining further portions of the features 260, 262. In the embodiment illustrated in FIGS. 5, 5A, 6, 6A and 6B, further layers of materials 260B, 260C and 262B, 262C, are applied over the glass layer 250 only in the areas of the features 260, 262 to cause the features 260, 262 to extend above the surface of the glass layer 250, i.e., to extend above the center section 270. The layers 260B, 262B may be formed over the layer 250 and from a cover glass material commercially available from Asahi Glass Company under the product designation AP5700 and the layers 260C, 262C may be formed over the layers 260B, 262B and from a cover glass commercially available from Asahi Glass Company under the product designation AP5349.

It is also contemplated that the features 260, 262 may be formed without using material corresponding to one or more of the resistors 220, conductors 230, and the glass layers 240, 250.

The heater element 200 is coupled to the housing 122 such that the substrate first outer surface 212 faces toward the inner surface 112 of the belt 110, see FIG. 4. During operation of the fuser assembly 100, the first and second features 260 and 262 engage the belt inner surface 112.

Figure 1:
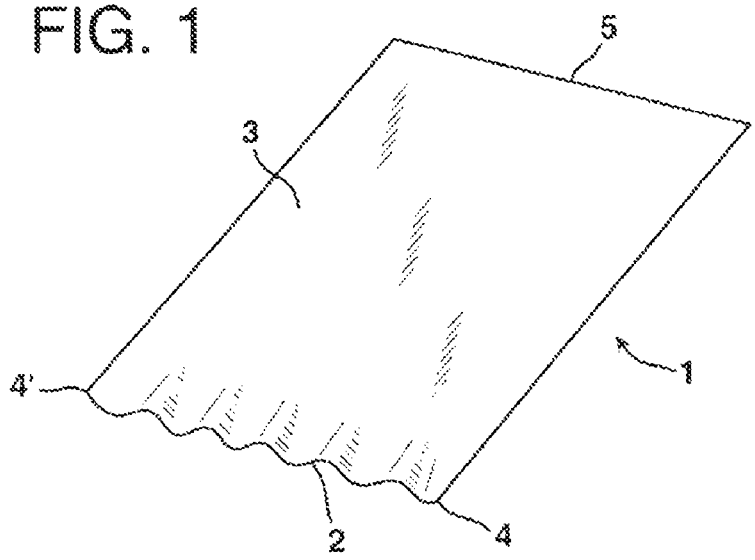
FIG. 1 is a perspective view of a substrate which has been exposed to a high level of ambient humidity on one end or edge causing the edge to become wavy.
Figure 2:
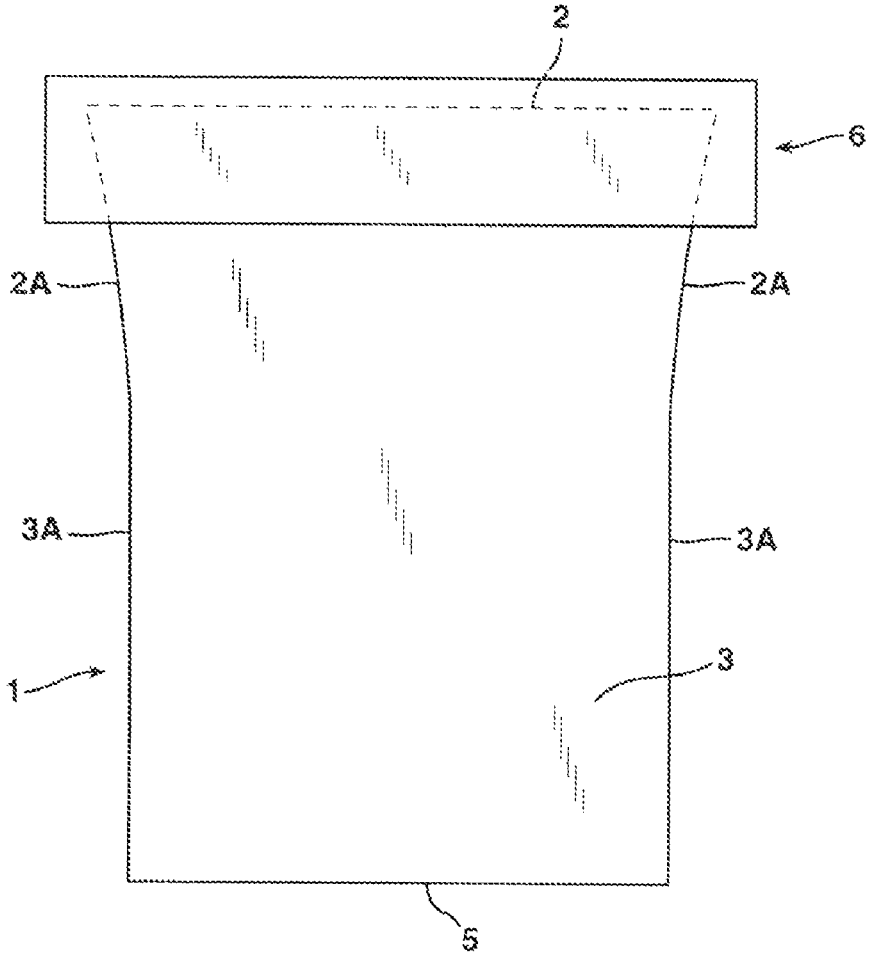
FIG. 2 PRIOR ART
FIGS. 2 and 3 illustrate the substrate in FIG. 1 passing through a conventional fusing nip.
Figure 3:
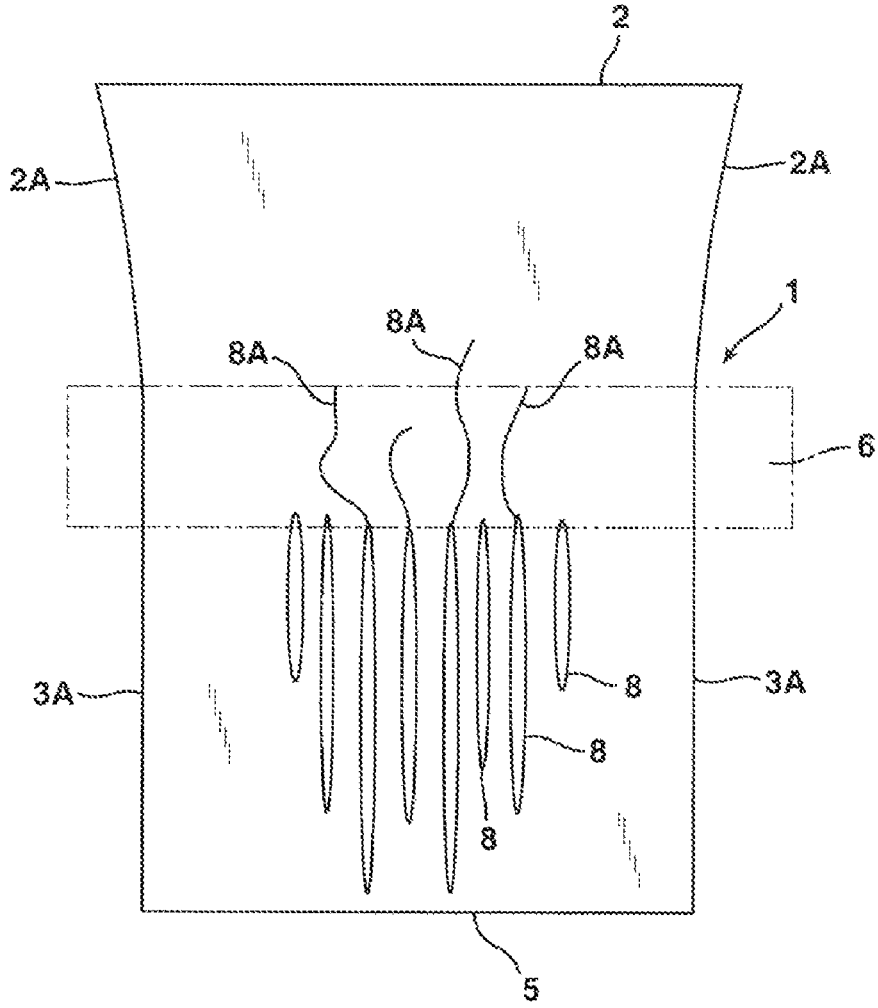
FIG. 3 PRIOR ART

A substrate 1 having a wavy leading edge 2, as illustrated in FIG. 1, is shown in FIGS. 7A and 7B passing into and through the fusing nip 140 of the fuser assembly 100. The size, i.e., diameter, of the backup roller 130 and the height of the features 260, 262 relative to the center section 270 are selected so that the backup roller 130 and the belt 110, at locations where the belt 110 passes beneath the features 260, 262, engage only laterally spaced-apart outer edge portions 9A, 9B of the substrate 1. As noted above, it is preferred that the backup roller 130 cause the belt 110 to engage the first feature 260 between the first line of contact $L_{C1}$ and the upper edge 2260A of the first rear surface 2260 and the second feature 262 between the second line of contact $L_{C2}$ and the upper edge 2262A of the second rear surface 2262, see FIGS. 8A and 8B. Thus, a center portion 9C of the substrate 1, when positioned between the belt 110 and the backup roller 130 in the area 300 between the features 260, 262, is not compressed or gripped by the belt 110 and the backup roller 130, see FIGS. 7A and 7B.

The features 260 and 262 function to create laterally spaced-apart low-pressure contact areas between the belt 110 and the backup roller 130 in front of, i.e., before, the fusing nip 140. Hence, the outer edge portions 9A, 9B of the substrate are gripped by the belt 110 and the backup roller 130 just prior to the fusing nip 140 while the center portion 9C of the substrate 1 is not gripped by the belt 110 and the backup roller 130 in the area 300 between the features 260, 262. When the way leading edge 2 of the substrate enters into the fusing nip 140, because the belt 110 and the backup roller 130 function to grip the substrate at its outer edge portions 9A, 9B at locations spaced a small distance from the fusing nip 140, the way leading edge 2 is constrained in a width-wise direction, i.e., between the corners 4 and 4', while passing through the nip 140 such that the leading edge 2 is not allowed to flatten out and expand. This, in turn, prevents corrugations from being formed in the center portion 9C and a trailing edge 5 of the substrate 1 that lead to wrinkle formation. Hence, wrinkle formation is prevented due to the use of features 260, 262 on the heater element 200.

When the fusing nip 140, the entire width of the substrate 1 is engaged and compressed by the belt 110 and the backup roller 130, including the center portion 9C of the substrate 1. The fusing nip 140 is defined between the backup roller 130 and the flexible belt 110 at a location where the belt 110 passes below a center portion 200A of the heater element 200, see FIGS. 4, 7A and 7B.

It is advantageous to locate the features 260, 262 on the heater element 200 instead of on another element within the fuser assembly 100. If the raised features are provided on another element and the other element is spaced from the heater element 200 and not heated, the other element may act as a heat sink conducting energy in the form of heat away from the belt 110 as the belt 110 moves across that element. Also, depending upon the material from which the other element is formed, it may abrade or otherwise damage the belt 110 during movement of the belt 110 across the other element. Further, because the features 260, 262 are positioned near the fusing nip 140, the velocities of laterally spaced-apart outer edges of the belt 110 within the fusing nip 140 are more likely to be substantially the same as the velocity of a center portion of the belt 110 as compared to a fuser assembly where the features are spaced away from the fusing nip 140.

It is contemplated that the features may be spaced from the resistors 220 and conductors 230 and the glass layers 240, 250 formed over the resistors 220 and conductors 230. Those features may be formed on the substrate first outer surface 212 via one or more of the same materials used to form the resistors 220, conductors 230, glass dielectric layer 240 and glass overglaze layer 250. It is also contemplated that separate rods or rectangular elements formed from glass or a like material may be secured to the ceramic substrate first outer surface 212 so as to define laterally spaced apart features on the heater element.

Figure 9:
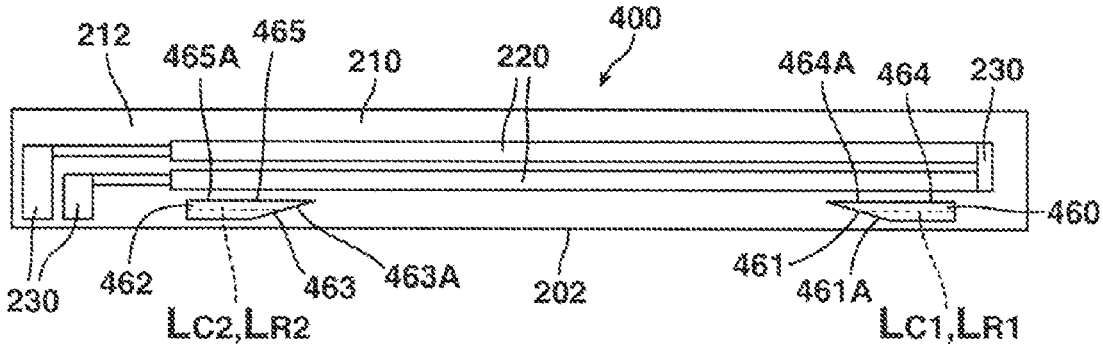
FIG. 9 is a top view of a heater element constructed in accordance with a second embodiment of the present invention.

A heater element 400, configured in accordance with a second embodiment of the present invention, is illustrated in FIG. 9, wherein like reference numerals indicate like elements. The heater element comprises first and second features 460 and 462, respectively. The first feature 460 comprises a first inner surface 461 having a first upper edge 461A. The second feature 462 comprises a second inner surface 463 having a second upper edge 463A. As is apparent from FIG. 9, the first inner surface 461 faces the second inner surface 463. As is also apparent from FIG. 9, the first and second inner surfaces 461, 463 face toward the substrate input edge 202 of the heater element 400.

Figure 9A:
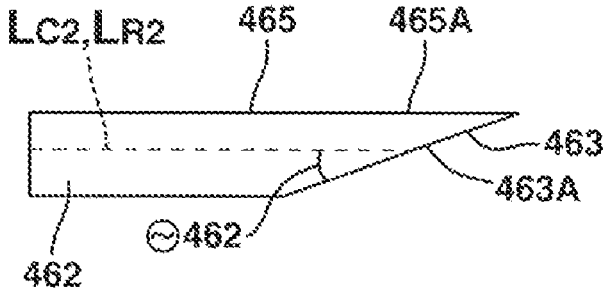
FIG. 9A is a top view of the second feature illustrated in FIG. 9.

During operation of a fuser assembly in which the heater element 400 is incorporated, the backup roller 130 causes the belt 110 to engage the first feature 460 between a first line of contact $L_{C1}$ and an upper edge 464A of a first rear surface 464 and the second feature 462 between a second time of contact $L_{C2}$ and an upper edge 465A of a second rear surface 465, see FIG. 9. The first time of contact $L_{C1}$ and the first upper edge 461A of the first inner surface 461 define a first oblique angle having a value of between about 5 degrees and 65 degrees and preferably about 15 degrees. As is apparent from FIG. 9A, the second line of contact $L_{C2}$ and the second upper edge 463A of the second inner surface 463 define a second oblique angle $\theta_{462}$ having a value of between about 5 degrees and 65 degrees and preferably about 15 degrees. First and second reference lines $L_{R1}$ and $L_{R2}$, which extend substantially perpendicular to the substrate path A, overlap, are coextensive with and are defined by the first and second lines of contact $L_{C1}$ and $L_{C2}$ in this embodiment.

Figure 10:
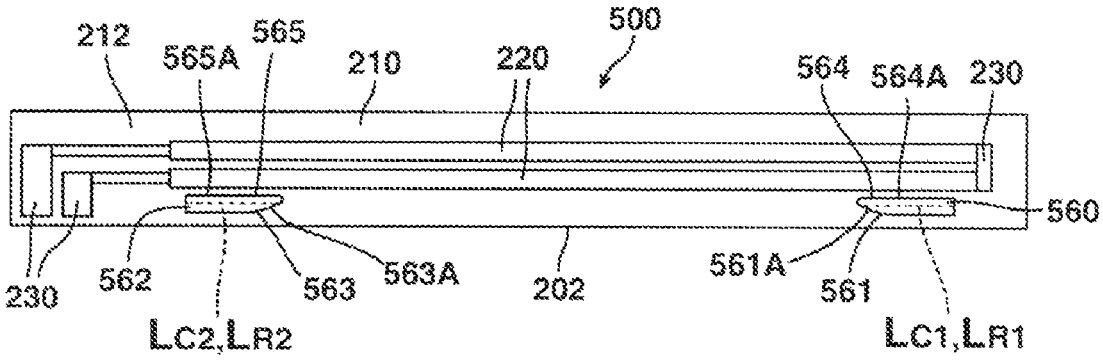
FIG. 10 is a top view of a heater element constructed in accordance with a third embodiment of the present invention.

A heater element 500, configured in accordance with a third embodiment of the present invention, is illustrated in FIG. 10, wherein like reference numerals indicate like elements. The heater element comprises first and second features 560 and 562, respectively. The first feature 560 comprises a first curved inner surface 561 having a first curved upper edge 561A. The second feature 562 comprises a second curved inner surface 563 having a second curved upper edge 563A. As is apparent from FIG. 10, the first inner surface 561 faces the second inner surface 563. As is also apparent from FIG. 10, the first and second inner surfaces 561, 563 face toward the substrate input edge 202 of the heater element 500.

Figure 10A:
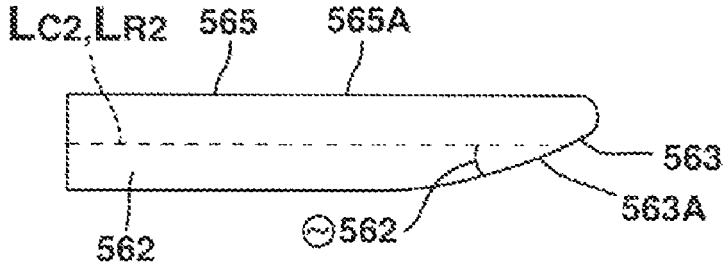
FIG. 10A is a top view of the second feature illustrated in FIG. 10.

During operation of a fuser assembly in which the heater element 500 is incorporated, the backup roller 130 causes the belt 110 to engage the first feature 560 between a first line of contact $L_{C1}$ and an upper edge 564A of a first rear surface 564 of the first feature 560 and the second feature 562 between a second line of contact $L_{C2}$ and an upper edge 565A of a second rear surface 565 of the second feature 562, see FIG. 10. The first line of contact $L_{C1}$ and the first upper edge 561A of the first inner surface 561 define a first oblique angle having a value of between about 5 degrees and 65 degrees and preferably about 15 degrees. As is apparent from FIG. 10A, the second line of contact $L_{C2}$ and the second upper edge 563A of the second inner surface 563 define a second oblique angle $\theta_{562}$ having a value of between about 5 degrees and 65 degrees and preferably about 15 degrees. First and second reference lines $L_{R1}$ and $L_{R2}$, which extend substantially perpendicular to the substrate path A, overlap, are coextensive with and are defined by the first and second lines of contact $L_{C1}$ and $L_{C2}$ in this embodiment.

Figure 11:
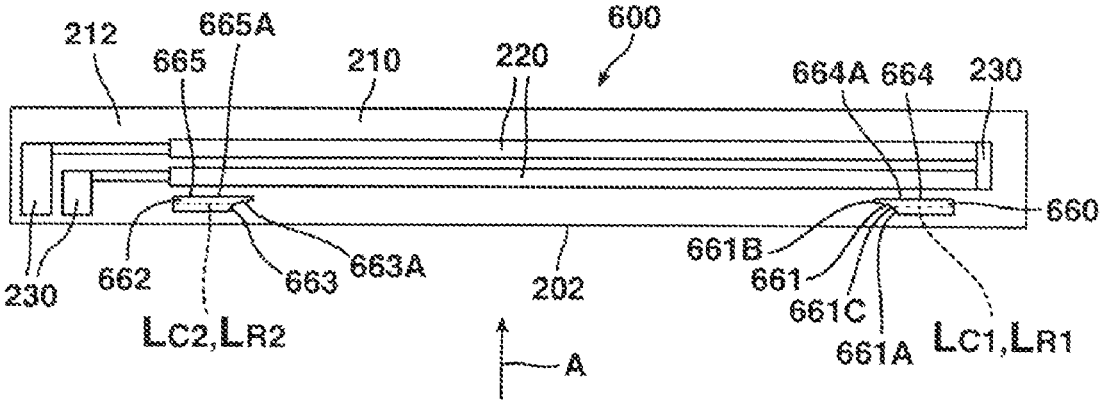
FIG. 11 is a top view of a heater element constructed in accordance with a fourth embodiment of the present invention.

A heater element 600, configured in accordance with a fourth embodiment of the present invention, is illustrated in FIG. 11, wherein like reference numerals indicate like elements. The heater element comprises first and second features 660 and 662, respectively. The first feature 660 comprises a first inner surface 661 having a first upper edge 661A. The second feature 662 comprises a second inner surface 663 having a second upper edge 663A. As is apparent from FIG. 11, the first inner surface 661 faces the second inner surface 663. As is also apparent from FIG. 11, the first and second inner surfaces 661, 663 face toward the substrate input edge 202 of the heater element 600.

Figure 11A:
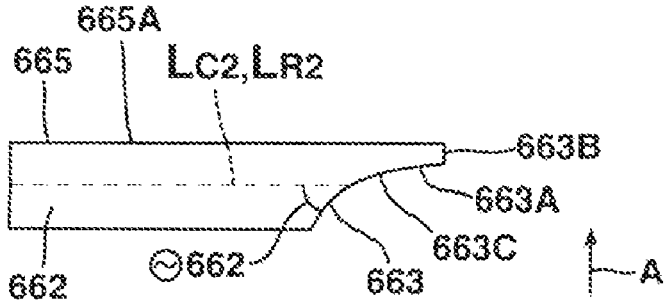
FIG. 11A is a top view of the second feature illustrated in FIG. 11.

As is apparent from FIG. 11, the first inner surface 661 has a minor portion 661B which is substantially parallel to the substrate path A and a curved majority portion 661C which is positioned at an oblique angle to the first line of contact $L_{C1}$. Also, the second inner surface 663 has a minor portion 663B which is substantially parallel to the substrate path A and a curved majority portion 663C which is positioned at an oblique angle to the second line of contact $L_{C2}$, see FIG. 11A.

During operation of a fuser assembly in which the heater element 600 is incorporated, the backup roller 130 causes the belt 110 to engage the first feature 660 between a first line of contact $L_{C1}$ and an upper edge 664A of a first rear surface 664 of the first feature 660 and the second feature 662 between a second line of contact $L_{C2}$ and an upper edge 665A of a second rear surface 665 of the second feature 662, see FIG. 11. The first line of contact $L_{C1}$ and the first upper edge 661A of the first inner surface majority portion 661C define a first oblique angle having a value of between about 5 degrees and 65 degrees and preferably about 15 degrees. As is apparent from FIG. 11A, the second line of contact $L_{C2}$ and the second upper edge 663A of the second inner surface majority portion 663C define a second oblique angle $\theta_{662}$ having a value of between about 5 degrees and 65 degrees and preferably about 15 degrees. First and second reference lines $L_{R1}$ and $L_{R2}$, which extend substantially perpendicular to the substrate path A, overlap, are coextensive with and are defined by the first and second lines of contact $L_{C1}$ and $L_{C2}$ in this embodiment.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A heater element adapted to heat a belt in a fuser assembly comprising:

laterally spaced-apart first and second features, said first feature having a first inner surface and said second feature having a second inner surface facing said first inner surface, wherein at least a majority portion of at least one of said first and second inner surfaces is positioned at an oblique angle relative to a reference line extending substantially perpendicular to a path a media sheet moves along as it passes through the fuser assembly;

a substrate having first and second outer surfaces, the first and second features being provided on said substrate first outer surface;

material provided on said substrate first outer surface, a first portion of said material provided on said substrate first outer surface defining one or more elements generating heat when passing a current, the first and second features being electrically isolated from the one or more elements generating heat; and one or more glass layers provided over said material and at least one section of said substrate first outer surface not including said material.

2. A heater element as set out in claim 1, wherein said features are positioned on said substrate first outer surface near an input edge of said substrate, between the input edge and the material, said first and second features being physically separated in their entirety from the one or more heat generating elements on said substrate.

3. A heater element as set out in claim 1, wherein said majority portion of said first inner surface faces an input edge of said substrate, the input edge being a longitudinal edge of said substrate.

4. A heater element as set out in claim 1, wherein said majority portion of said first inner surface faces away from a longitudinal edge of said substrate and towards the material.

5. A heater element as set out in claim 1, wherein said majority portion of said first inner surface is curvilinear.

6. A heater element as set out in claim 1, wherein said majority portion of said first inner surface is substantially planar.

7. A heater element as set out in claim 1, wherein a portion of each of said one or more glass layers forms a portion of one of said first and second features.

8. A heater element as set out in claim 1, wherein said material further comprises second portions provided on said substrate first outer surface for defining portions of said first and second features.

9. A heater element as set out in claim 1, further comprising one or more additional layers of material provided only on areas corresponding to said features for defining portions of said features.

10. An apparatus for fixing a toner image on a substrate comprising:

a heater assembly comprising a housing and a heater element mounted in said housing;

a flexible belt positioned about said heater assembly and including an inner surface engageable with said heater element so as to receive energy in the form of heat generated by said heater element;

a backup member positioned in opposition to said heater assembly, said flexible belt extending between said heater assembly and said backup member such that a fusing nip for receiving a media sheet is defined between said backup member and said flexible belt at a location where said belt passes below a center portion of said heater element; and said heater element comprising a substrate having first and second surfaces, at least one heat generating member disposed on said first surface, and laterally spaced-apart first and second features disposed on said first surface and facing said belt inner surface, said backup member causing said belt to engage said first and second features along respective first and second lines of contact, said first line of contact terminating at a first edge of said first feature and said second line of contact terminating at a second edge of said second feature, said first line of contact and said first edge defining a first oblique angle and said second line of contact and said second edge defining a second oblique angle, said first and second features being entirely disposed in spaced relation from and substantially electrically unconnected to said at least one heat generating member.

11. An apparatus as set out in claim 10, wherein said heater element further comprises;

one or more glass layers provided over said at least one heat generating member and at least one section of said substrate first outer surface not including said at least one heat generating member.

12. An apparatus as set out in claim 11, wherein a portion of each of said one or more glass layers forms a portion of each of said features.

13. An apparatus as set out in claim 10, wherein said portions of said features and portions of said at least one heat generating member have the same composition.

14. An apparatus as set out in claim 10, wherein said first feature comprises a first inner surface having an edge defining said first edge and said second feature comprises a second inner surface having an edge defining said second edge, said second inner surface facing said first inner surface, wherein majority portions of said first and second inner surfaces are positioned at oblique angles relative to said first and second lines of contact.

15. An apparatus as set out in claim 14, wherein said features are positioned near a leading edge of said heater element.

16. An apparatus as set out in claim 14, wherein said majority portion of said first inner surface faces a leading edge of said heater element.

17. An apparatus as set out in claim 14, wherein said majority portion of said first inner surface faces away from a leading edge of said heater element.

18. An apparatus as set out in claim 14, wherein said majority portion of said first inner surface is curvilinear.

19. An apparatus as set out in claim 14, wherein said majority portion of said first inner surface is linear.

20. The heater element of claim 1, wherein said first and second features extend outwardly from said substrate first outer surface further than an extent to which said one or more elements generating heat extend, relative to said substrate first outer surface.

21. The apparatus of claim 10, wherein said first and second features extend further outwardly from said substrate first surface than an extent to which said at least one heat generating member extends from said substrate first surface.

22. An apparatus for fixing a toner image on a substrate comprising:

a media feedpath for moving a media sheet;

a heater assembly comprising a housing and a heater element having bottom surface and mounted in said housing;

a flexible belt positioned about said heater assembly and including an inner surface engageable with said heater element so as to receive energy in the form of heat generated by said heater element;

a backup member positioned in opposition to said heater assembly, said flexible belt extending between said heater assembly and said backup member such that a fusing nip for receiving the media sheet is defined between said backup member and said flexible belt; and said heater element comprising a substrate having a first surface, at least one heat generating member disposed along said first surface, and laterally spaced-apart first and second features disposed on the first surface of the substrate and engaging the inner surface of the belt, the first and second members being substantially entirely spatially separated from and electrically unconnected to the at least one heat generating member, the first and second features each comprising a major surface disposed at an oblique angle relative to at least one line substantially perpendicular to a direction of travel of the media sheet along the media feedpath near the heater assembly.

* * * * *